United States Patent [19]

McDonald et al.

[11] 4,049,081

[45] Sept. 20, 1977

[54] OPERATOR-ACTUATED ELEVATING DEVICE

[76] Inventors: Walter McDonald, 558 Dell Road, Landing, N.J. 07850; Norbert F. Seitel, 45 Gilette Place, Gilette, N.J. 07933; John E. Ayres, 540 Fairview Ave., Westwood, N.J. 07675

[21] Appl. No.: 648,384

[22] Filed: Jan. 12, 1976

[51] Int. Cl.[2] ..... E06C 7/12; B66B 9/20

[52] U.S. Cl. ..... 182/148; 182/103; 187/9 E; 187/10

[58] Field of Search ..... 182/148, 141, 103, 168; 187/9 R, 9 E, 10

[56] References Cited

U.S. PATENT DOCUMENTS

| | | | |
|---|---|---|---|
| 2,576,277 | 11/1951 | Biegen | 182/168 |
| 3,052,323 | 9/1962 | Hopfeld | 187/10 |
| 3,196,981 | 7/1965 | Winnall | 182/148 |
| 3,799,289 | 3/1974 | Cecere | 182/148 |

*Primary Examiner*—Reinaldo P. Machado
*Attorney, Agent, or Firm*—Stefan J. Klauber

[57] ABSTRACT

An elevatable operator-actuated lifting device, including a lower support frame and a platform section telescopically interfitted with the support frame as to be elevatable with respect thereto. Hydraulically actuated piston and cylinder means are provided for telescoping and de-telescoping the platform section with respect to the support frame, to enable elevation and lowering of the platform section. Means moveable with the platform section, including a manually actuated hydraulic pump, enable pressurization and de-pressurization of the piston and cylinder means, to thereby enable raising and lowering of the platform section by an operator standing thereupon.

7 Claims, 8 Drawing Figures

FIG. 4
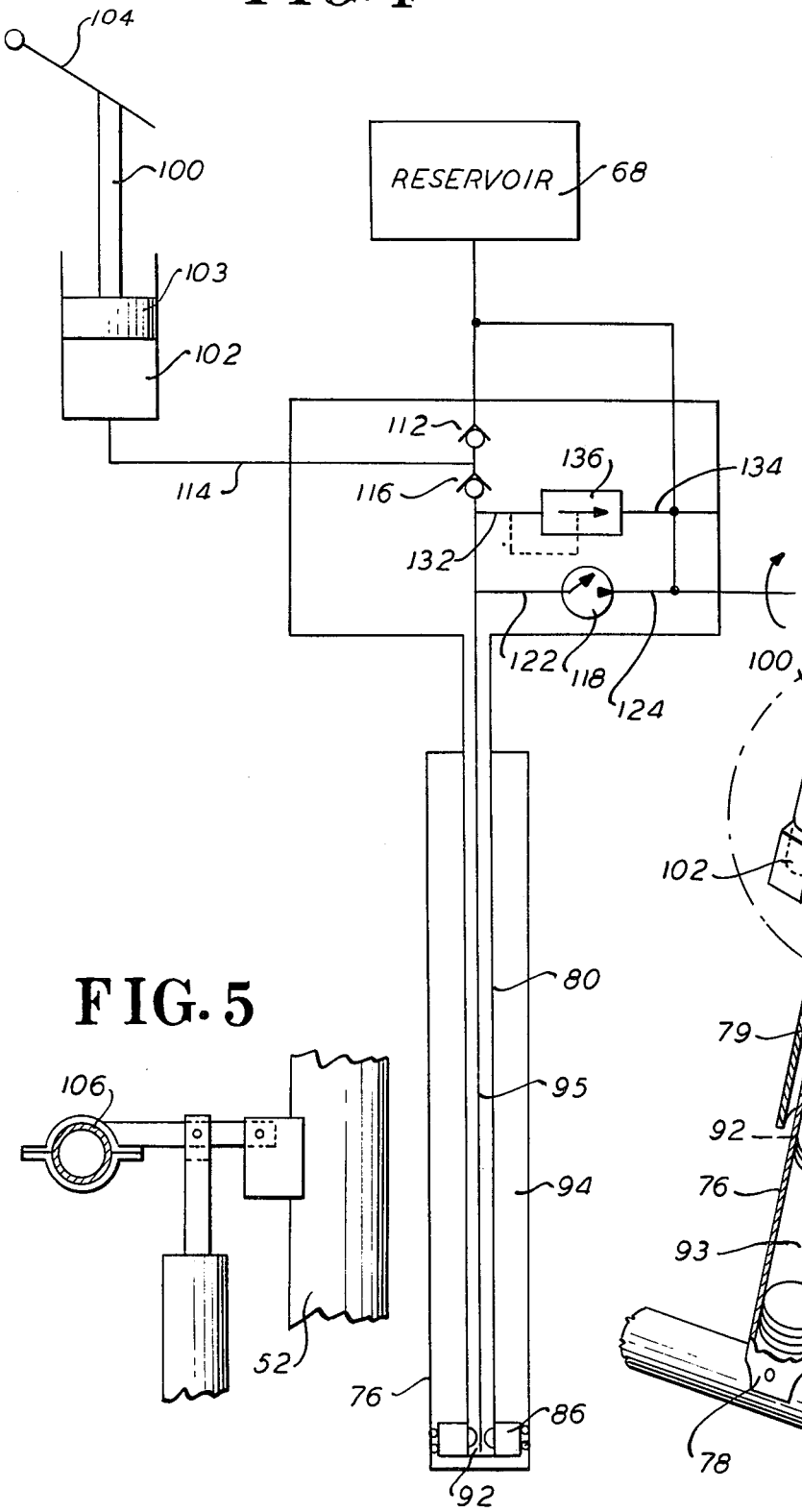
FIG. 3
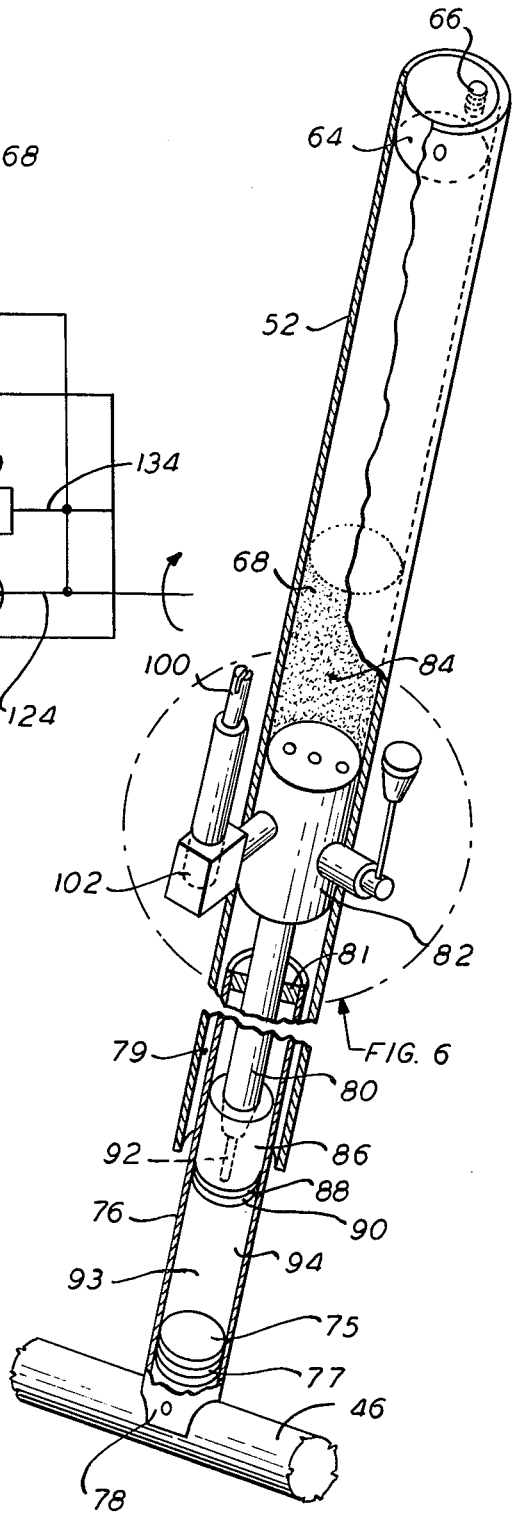
FIG. 5

OPERATOR-ACTUATED ELEVATING DEVICE

BACKGROUND OF INVENTION

This invention relates generally to elevating and lifting apparatus, and more specifically relates to portable platforms of the type suitable for personal use — in a manner functionally analagous to the use of step ladders or the like.

The common step ladder is a device of virtually universal application, and indeed it would be difficult to find a household or industrial environment in which one or more such devices were not present and commonly utilized. While these devices are generally well suited for their intended purpose, it is nonetheless true that they possess certain inherent problems which both reduce their effectiveness and tend to render them unsafe — particularly when utilized by individuals unaccustomed to their use and/or to working at elevated positions. Indeed the average homeowner falls within the category of individuals cited. The said step ladders, further, are deemed particularly dangerous for use by older or infirmed individuals — who find it difficult to ascend and descend the typical step ladder, and to maintain themselves in a stable working position, especially when positioned at the higher treads of the ladder.

In the past, various proposals have been made for devices intended to function in the nature of a step ladder, i.e. to achieve elevation of an individual to a working height, and yet solve some of the difficulties inherent in step ladder structures. In a number of instances, e.g. efforts have been made to substitute an elevatable platform or the like for overlying treads, thereby both reducing the dangers of climbing and increasing stability for the operator. Some such devices have included mechanical assisting elements, such as electrically actuated hoists, hydraulic lifts or the like, or even simple mechanical elevating devices. By and large however, the prior proposals in this field have not been particularly successful, usually because they lacked simplicity of operation, and were not truly adapted to the small homeowner or the like, but rather were of such complexity (and commensurate cost) as to only be truly suited for use in industrial environments.

In accordance with the foregoing, it may be regarded as an object of the present invention, to provide a portable lifting platform which is adapted to completely safe operation by unskilled individuals, and which enables effective lifting of such individuals to a desired work height, while such individuals remain positioned upon a highly stable platform.

It is a further object of the present invention, to provide a lifting device having a configuration reminiscent of a portable step ladder, which device is light and portable, requires no external power input, and which therefore is completely safe for use by individuals desiring to be lifted to a specified work height.

It is a still further object of the present invention, to provide a highly portable and dependable lifting device, which enables an individual using same to ascend to a desired height by means of a simple hydraulic pump actuated by the said individual, and without any requirement for said individual to move between stiles.

It is a yet further object of the invention, to provide a portable lifting platform of the foregoing type, which further, includes support means for the upper part of the body, which means ascend with the individual so as to assure his stability at all times during his use of the apparatus.

SUMMARY OF INVENTION

Now in accordance with the present invention, the foregoing objects, and others as will become apparent in the course of the ensuing specification, are achieved in an elevatable operator-actuated lifting device which includes a lower support frame, and a platform section telescopically interfitted with the support frame as to be elevatable with respect thereto. Hydraulically-actuated piston and cylinder means are provided for telescoping and de-telescoping the platform section with respect to the support frame, to enable elevation and lowering of the platform section. Means moveable with the platform section, including a manually-actuated hydraulic pump, enable pressurization and depressurization of the piston and cylinder means, to thereby enable raising and lowering of the platform section by an operator. The platform section includes toward the bottom thereof, a support platform for the operator; and the operator remains fixed (with respect to this platform) during use of the apparatus, whereby no requirement exists for moving among stiles or so forth. The platform section has a length approximating that of the support frame, which, in turn, may be of shoulder height or thereabouts. Since the platform section moves upwardly as a unit during elevation of the present device, the upper portions of same are at all times accessible to and proximate the operator, thereby providing available bracing means for the operator during elevation of the platform, and during subsequent work operations. The upper portion of the platform section, preferably carries as well, a work support platform, upon which work pieces, tools, or work material such as paint, etc. may be positioned, and safely elevated along with the operator.

BRIEF DESCRIPTION OF DRAWINGS

The invention is diagrammatically illustrated, by way of example, in the drawings appended hereto, in which:

FIG. 3 is a perspective partially cut-away and sectioned view of the principal elements of the hydraulic system utilized in the device of FIGS. 1 and 2; and especially illustrates the arrangement of the hydraulically actuated piston and cylinder;

FIG. 4 is a simplified schematic diagram, illustrating the essential elements comprising the hydraulic system in the present device, and the manner in which such elements function in the invention;

FIG. 5 is a partial, side elevational view (with portions sectioned), illustrating the external arrangement of the pump and pump actuating portions of the present device;

DESCRIPTION OF PREFERRED EMBODIMENT

Figure 1:
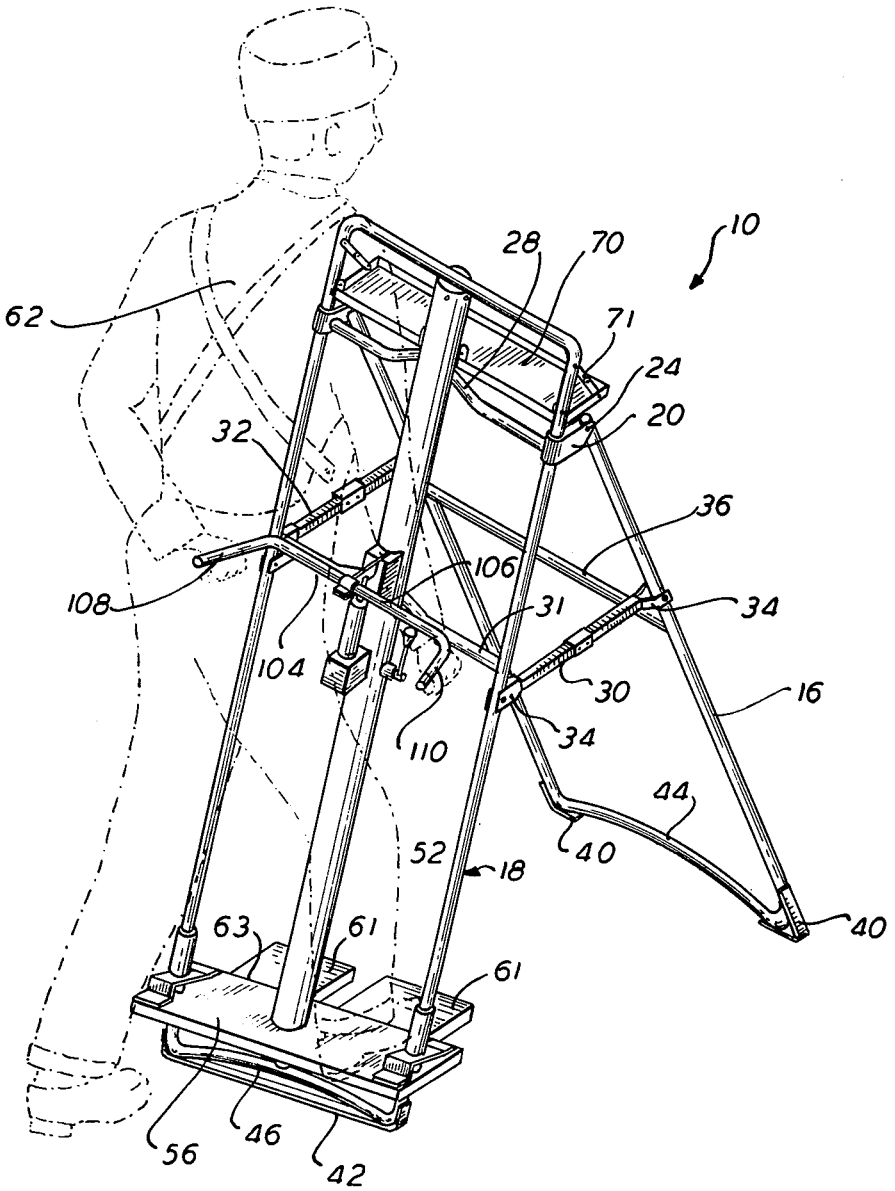
FIG. 1 is a perspective view illustrating an elevatable operator-actuated lifting device in accordance with the invention, the said device being shown in its lowered position, with the operator positioning himself thereupon.
Figure 2:
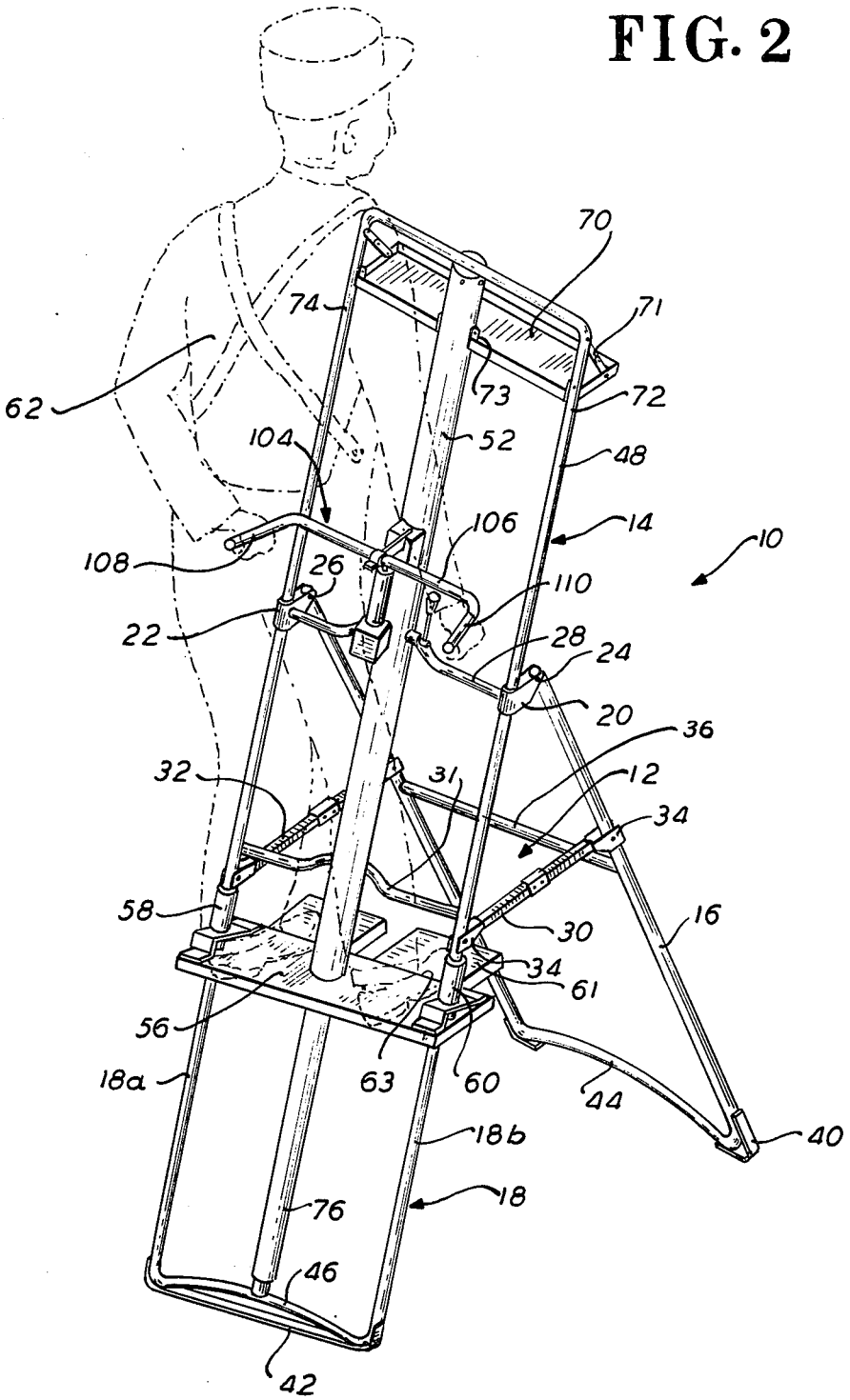
FIG. 2 is a further perspective view, similar to FIG. 1, but showing the said device in a raised position, with the operator in place upon the device.

In FIGS. 1 and 2 perspective views appear, which respectively illustrate the lifting apparatus 10 of the present invention in its lowered and raised configurations. The apparatus 10 is thus seen to comprise a lower support frame, generally designated at 12; and a platform section, generally designated at 14 (FIG. 2). The section 14 is telescopically interfitted within support frame 12, and is elevatable with respect thereto in order to enable raising and lowering of the apparatus Lower support frame 12 is defined by a pair of tubular U-shaped sections 16 and 18, formed e.g. of aluminum tubing or the like. Sections 16 and 18 are hingedly secured to one another at the open ends of the U, by means of brackets 20 and 22, the said brackets being directly secured to the uppermost portion of section 18 and being secured to section 16 by a pair of pins 24 and 26, which enable the cited pivoting action. Cross-bracing members 28 and 31 extend across section 18, in order to increase the rigidity of the present structure.

A pair of foldable braces 30 and 32, extend between sections 16 and 18 at a location toward the upper ends thereof. The said foldable braces are secured to sections 16 and 18 by pivot mounts 34. It will thus be evident from the construction illustrated, that apparatus 10 can readily be folded for storage — much in the manner in which folding of a common step ladder is effected, i.e. by raising foldable braces 30 and 32, and then pivoting the sections 16 and 18 toward one another to produce a relatively flat structure. This operation is, of course, effected when platform section 14 is in its lowered position, as in FIG. 1. Similarly it will be evident that when the said structure is in its open position, as shown in either FIGS. 1 or 2, a relatively very stable device is provided by virtue of the various cross-bracing, which, in addition to the members previously described, includes a further cross brace 36 which extends across U section 16. It should be noted that base support strips 40 and 42 are secured to the lower base sections 44 and 46 of each of the sections 16 and 18, in order to better distribute the load which would otherwise be concentrated toward the other portions of the base sections 44 and 46 by virtue of the formed radius at the corners of the U-shaped sections.

The platform section 14, as may be best seen from the FIGS. 1 and 2, comprises generally an inverted tubular U-shaped frame 48, which is intertelescoped with section 18 of the support frame 12. The nature of the intertelescoping arrangement, as shortly will be evident, includes the hydraulic actuating means which enables elevation of the platform section with respect to the underlying support section. Details of this latter arrangement may be seen from simultaneous consideration of FIGS. 1 and 2 together with the detailed showing of FIG. 3.

Thus it is firstly seen that a central hollow tubular cylinder 52 passes into an operator support platform 56, with which it is fixedly engaged. The operator platform 56 includes at its opposite sides guide portions 58 and 60, which are secured to the platform, and slidingly engage the sides 18*a* and 18*b* of section 18, which sides serve as guide rails during upward and downward movement of platform 56. It will be noted that the said platform has a relatively extended front-to-rear dimension, and may include slight extensions 61, which further add to the front-to-rear dimensions at a point where the operator 62 stands. This lends yet increased stability to the operator in his working and standing position.

Extensions 61 are hingedly attached to platform 56 so that they may fold upwardly about line 63 when the device is collapsed for storage. The upper end of platform section 16 also includes a work support platform 70, which is secured to section 14 by attahment to the side rails 72 and 74. This support platform moves upwardly and downwardly with section 14, and serves to provide a convenient locale for placing work pieces, tools, cans of material such as paints, etc. Platform 70 is also hinged as at 73 and at its attachment points to rails 72 and 74, whereby it may be folded in an upward direction during storage of device 10. The braces 71 for platform 70 are similarly collapsible — to facilitate the same objective.

The upper end of tubular member 52, as may be seen from FIG. 3, is provided with a closure 64, which has a filler plug 66 toward one side thereof. This filler plug is utilized for providing hydraulic fluid to a reservoir 68 formed internally of tubular member 52.

With the aid of the foregoing the basic operation of the present device may now be set forth. In particular, it will be seen that a tubular member 76 extends upwardly from the base section 46 of section 12. This member 76 is closed at its lower end by a sealing plug 75 which carries a sealing ring 77, and is also received in coupler 78 which projects from section 46. The tubular member 76 is, in turn, received within the tubular member 52, with a clearance 79 being provided between the two to enable movement of section 14 during elevation and lowering of the said platform. A piston rod 80 extends downwardly from a valve body block 82 secured within member 52, the reservoir 68 of hydraulic fluid 84 residing above the said block 82. Rod 80 passes into member 76 through a stop 81, and at the lower end thereof a piston 86 is mounted. The said piston is slideable within the cylinder 94 defined within member 76, and includes sealing rings 88 and 90 for assuring a proper seal between the walls of the cylinder and the piston.

Piston 86 includes a central passageway 92 extending from the top to bottom thereof, which enables hydraulic fluid provided to the upper end of the piston to flow beneath the piston, i.e. into the lower part of cylinder 94 — which lower part can be regarded as a pressure chamber 93. The passageway 92 in turn communicates directly with a similar central passageway 95 (FIG. 6), which precedes the entire length of rod 80 and thence enters the valve body block 82 at passage 98 into which rod 80 is threadingly received as seen from FIGS. 6 and 7. The flow of hydraulic fluid through passageway 95 and thence ultimately to the pressure chamber 93, i.e. flow from the reservoir 68, is controlled by a suitable valve and pumping arrangement — which enables the operator to manually pump fluid into pressure chamber 93, to thereby force piston 86 in an upward direction (in the sense of FIG. 3).

The foregoing action in particular is effected by suitable positioning of the valves now to be discussed, followed by manual actuation of the pumping means — which includes the plunger 100, and a cylinder 102 in which a piston 103 is displaced by upward and downward movement of plunger 100. The said pumping action is, in turn, enabled through up and down manual actuation of the pumping lever 104. The latter, as can be seen from FIGS. 1, 2 and 5, includes a cross piece 106, and hand grasping portions 108 and 110, which enable operator 62 to readily operate the pump in any position in which he may then be working or standing. Again, it is emphasized that during the resultant upward movement of section 14, the entire said section moves as a unit — with the upper portion thereof (at about shoulder height) being completely accessible to operator 62, who may readily grasp same in order to stabilize himself during or subsequent to elevation.

The hydraulic system arrangement may be best understood by consideration of FIGS. 3, 6, 7 and 8, and by simultaneous examination of the equivalent hydraulic schematic diagram of FIG. 4. In particular it will be seen that the piston 103, operated by means of pumping lever 104 reciprocates within cylinder 102. Hydraulic fluid 84 preceding from reservoir 68 is drawn into cylinder 102 upon the upward stroke, i.e. upon withdrawal of piston 103 the said fluid precedes through check valve 112 and line 114 into cylinder 102. Thereupon, i.e. upon the downward movement of piston 103 (due to manual actuation) the fluid precedes via line 114 and the second check valve 116, thence down the low path defined by passage 95 preceding (as already mentioned) through piston rod 80, thence through piston 86, and below same and into the underlying pressure chamber 93. It should be noted in considering the enlarged detail views of FIGS. 6 through 8 that conduit 113 which functionally corresponds to line 114 of schematic FIG. 4 is threadingly received into opening 115 of valve body block 82 which opening then communicates with space 117 between the check valves 112 and 116. It should be appreciated too that the opening 115 in FIG. 7 has been rotated 90° from its true plane in order to depict it in this Figure — as is evident by comparison with FIGS. 6 and 8.

As the pressurization builds up in chamber 93, it will be evident that the relative movement already described, occurs between the member 76 and piston 86 — which effects the upward movement of the platform section 14. During such upward operation a return valve 118 (FIG. 4) is placed in the position shown in such Figure, i.e. the return valve is closed, blocking return flow to the reservoir.

Figure 6:
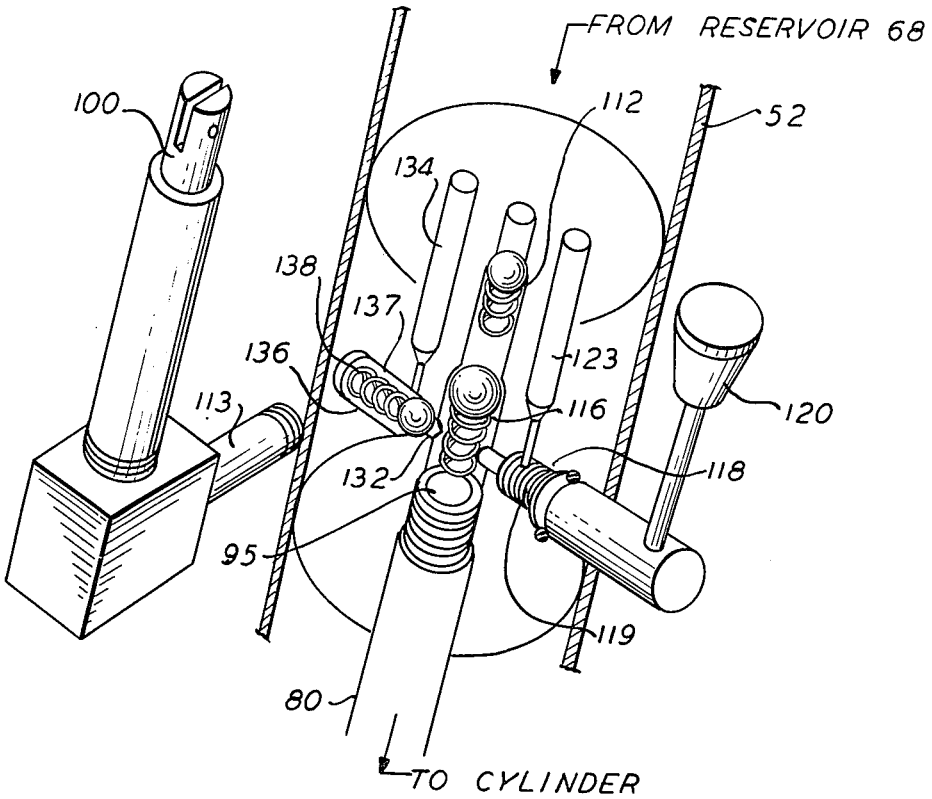
FIG. 6 is an enlarged view of the portion of FIG. 3 depicted with the dotted circle of FIG. 3, and illustrates in greater detail the arrangement of the control valves and fluid passageways.
Figure 7:
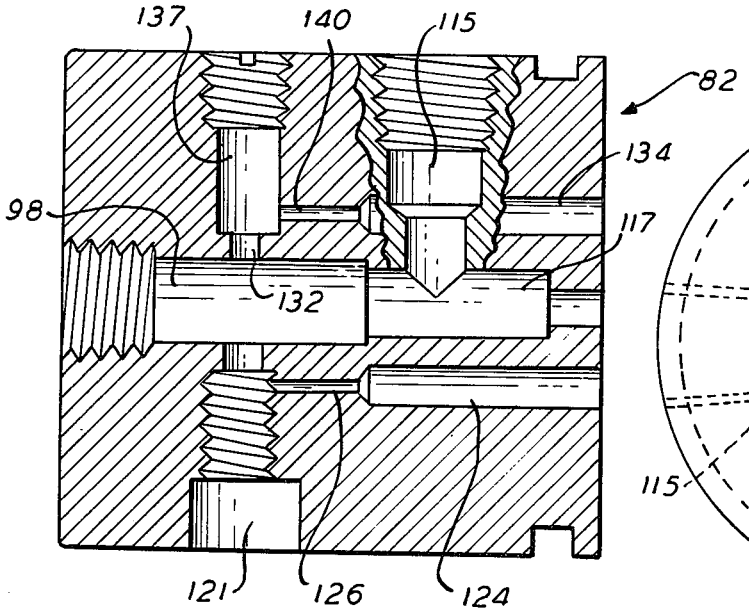
FIG. 7 is a longitudinal cross-sectional view of the valve body block of FIGS. 3 and 6.
Figure 8:
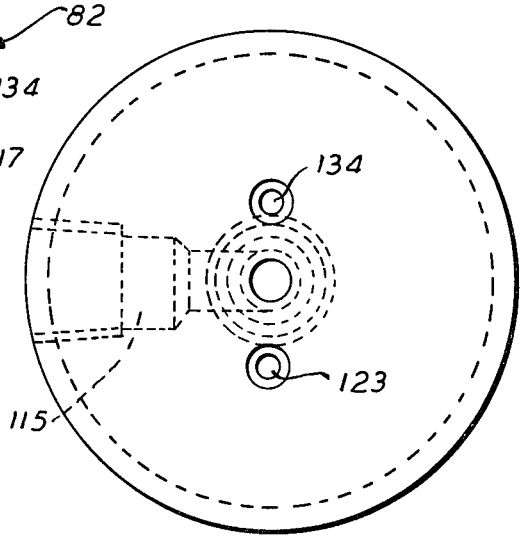
FIG. 8 is a top plan view of the said valve body block.

As can be seen from FIGS. 6 and 7, return valve 118 comprises a member 119 which is threadingly received into opening 121 of valve body block 82. The member may be advanced or withdrawn by the operator rotating same via handle control 120, which thus opens or closes the flow path to reservoir 68 which includes space 98 and passage 124. When the operator desires to thereafter descend, all that is necessary is for him to displace the return valve 118, by rotating control 120, which then enables a return flow path through passage 124, to reservoir 68. This return path preferably includes a slight restriction 126, so that the lowering of the platform section 14 with the operator on same, occurs in a slow controlled fashion.

The hydraulic system in the present device, further includes an overload protection mechanism, which assures that the present elevating device is not overloaded by the carrying of too much weight — as represented either by the individuals thereupon, or by excessive weight in the work pieces conveyed. In particular, and again referring particularly to FIGS. 4, and 6 through 8, it will be seen that an overload bypass is constituted by the flow passages 132 and 134 with a check valve 136 being provided in space 137 between passages 132 and 134. It will be clear that this overload bypass line including the check valve 136, is effectively connected in parallel across the pressurization chamber 93 and reservoir 68. Check valve 136 is pre-set, as e.g. by the spring constant of the bias spring 138 therein, so as to open at a predetermined pressure level. Thus in particular it will be evident that should the pressure within chamber 93 rise excessively as, for example, due to the causes previously mentioned, the bypass line will open by virtue of check valve 136 opening. The fluid in pressure chamber 93 then will be returned to the reservoir through the bypass line, until the pressure level is adequately relieved. A suitable restriction 140 can be provided within the bypass line, to assure that this relief flow does not occur in too precipitous a fashion — so that the net effect observed by an operator is not dissimilar from that which occurs where return valve is actuated to lower platform section 14.

While the present invention has been particularly set forth in terms of specific embodiments thereof, it will be understood in view of the present disclosure, that numerous variations upon the invention are now enabled to those skilled in the art, which variations yet reside within the scope of the present teaching. Accordingly the invention is to be broadly construed, and limited by the scope and spirit of the claims now appended hereto.

We claim:

1. An elevatable operator-actuated lifting platform, comprising in combination:

a lower support frame;

a platform section including means for supporting said operator, telescopically interfitted with said support frame as to be elevatable with respect thereto;

hydraulically actuated piston and cylinder means, for telescoping and de-telescoping said platform section away from and toward said support frame, to enable elevation and lowering of said platform section;

said piston and cylinder means including a cylinder associated with and fixed with respect to one of said support frame and platform, and a piston fixed with respect to the other of said frame and platform; said piston being received within said cylinder and being axially displaceable outwardly from said cylinder by pressurization thereof to enable said elevation of said platform;

means moveable with said platform for manually pressurizing and de-pressurizing said piston and cylinder means with said fluid, to enable raising and lowering of said platform by said operator;

and wherein said manually actuated means moveable with said platform includes a reservoir of hydraulic fluid and a manually operable pumping means for providing said fluid to said cylinder; a first flow path being defined between said reservoir and said cylinder including said manually operable pumping means for effecting elevation of said platform section by pressurization of said cylinder; a second flow path being defined between said reservoir and pressurized cylinder for enabling return of fluid to said reservoir for lowering of said platform; and manually operable valve means moveable with said platform section for enabling operator selection between said first or second flow paths.

2. Apparatus in accordance with claim 1, further including a third flow path between said cylinder and said reservoir, said third flow path being controlled by check valve means openable at a preselected pressure within said cylinder; said third flow path thereby constituting a fluid bypass line openable by excessive pressure developed in said cylinder in response to overloading of said platform section.

3. Apparatus in accordance with claim 2, wherein said support frame includes an upwardly extending first tubular member comprising said cylinder; said platform section including a second tubular member carrying internally said hydraulic reservoir; a third member being coupled to said second tubular member, extending downwardly therefrom, said third member carrying said piston at the distal end thereof; and said piston engaging with the internal walls of said cylinder; a fluid communication path being defined through said third member and said piston into said cylinder; and said fluid communication path comprising a part of said first, second and third flow paths.

4. Apparatus in accordance with claim 1, wherein the operator-actuatable portion of the said pumping means comprises an externally accessible cross-bar, and a pair of handles at the ends of said cross-bar graspable by the hands of said operator, to enable ready application of high force levels by said operator during raising of said platform.

5. An elevatable operator-actuated lifting platform, comprising in combination;

a lower support frame comprising a pair of generally U-shaped tubular members, said members being pivotably secured to one another at the open ends of said U, the bases of said U's comprising the lowermost supports of said frame;

foldable support braces extending between said U-shaped tubular members at points intermediate said hinged portions and said bases to enable folding of said support frame, and thereby of said apparatus;

a platform section including means for supporting said operator, telescopically interfitted with one of said U-shaped members as to be elevatable with respect thereto, and thereby to be elevatable with respect to said support frame;

fluid actuated piston and cylinder means, for telescoping and de-telescoping said platform section away from and toward said support frame, to enable elevation and lowering of said platform section; and means moveable with said platform for manually pressurizing and de-pressurizing said piston and cylinder means with said fluid, to enable raising and lowering of said platform by said operator.

6. Apparatus in accordance with claim 5, wherein said platform section includes at the bottom thereof a support platform for said operator, said section being of approximately the height of said support frame, whereby the upper portions of said platform section provide bracing means for said operator during elevation of said platform section.

7. Apparatus in accordance with claim 6, wherein said platform section further includes a work-receiving support at the upper portion of said section.

* * * * *